US005393932A

United States Patent [19]

Young et al.

[11] Patent Number: 5,393,932

[45] Date of Patent: Feb. 28, 1995

[54] WIRE CONNECTOR

[75] Inventors: John S. Young, Leander; Robert B. Ericson; Gary S. Natwig, both of Austin, all of Tex.

[73] Assignee: Minnesota Mining and Manufacturing Company, St. Paul, Minn.

[21] Appl. No.: 145,372

[22] Filed: Oct. 29, 1993

Related U.S. Application Data

[63] Continuation-in-part of Ser. No. 17,852, Apr. 20, 1993, which is a continuation-in-part of Ser. No. 835,803, Feb. 14, 1992, abandoned.

[51] Int. Cl.[6] ..... H01R 4/02; H01R 43/02

[52] U.S. Cl. ..... 174/84 R; 29/869; 174/DIG. 8; 228/56.3

[58] Field of Search ..... 174/84 R, 84 C, DIG. 8; 228/56.3, 56.5, 224, 265; 29/869, 871, 873

[56] References Cited

U.S. PATENT DOCUMENTS

| | | | |
|---|---|---|---|
| Re. 33,591 | 5/1991 | Feeny et al. | 156/85 |
| 3,143,595 | 8/1964 | Martin | 174/84 C |
| 3,288,914 | 11/1966 | Fuller et al. | 174/84 R |
| 3,326,442 | 6/1967 | Fattor | 278/56.3 |
| 3,396,460 | 8/1968 | Wetmore | 174/84 R |
| 3,525,799 | 8/1970 | Ellisr | 228/56.3 |
| 4,084,876 | 4/1978 | Dinger . | |
| 4,199,211 | 4/1980 | Kidder | 174/84 C X |
| 4,300,284 | 11/1981 | Reeder | 29/860 |
| 4,304,959 | 12/1981 | Vidakovits et al. | 174/84 R |
| 4,384,404 | 5/1983 | Watine | 29/871 |
| 4,505,421 | 3/1985 | Gen et al. | 228/224 |
| 4,595,724 | 6/1986 | Koblitz | 174/84 R X |
| 4,654,473 | 3/1987 | Roux | 174/84 R |
| 4,722,471 | 2/1988 | Gray et al. | 228/265 |
| 4,832,248 | 5/1989 | Soni et al. | 228/56.3 |
| 4,852,252 | 8/1989 | Ayer | 29/860 |
| 4,867,691 | 9/1989 | Eck | 439/82 |
| 4,883,925 | 11/1989 | Graf | 174/84 R |
| 4,940,179 | 7/1990 | Soni | 228/56.3 |
| 4,987,283 | 1/1991 | Beinhaur et al. | 219/85.11 |
| 4,993,149 | 2/1991 | Zilligen et al. | 29/859 |
| 5,006,286 | 4/1991 | Dery et al. | 264/40.2 |
| 5,052,610 | 10/1991 | Guerra et al. | 228/56.3 |
| 5,140,746 | 8/1992 | Debbaut | 174/84 C |
| 5,201,914 | 4/1993 | Hollick . | |

FOREIGN PATENT DOCUMENTS

| | | |
|---|---|---|
| 1149125 | 4/1969 | United Kingdom . |
| 1246543 | 9/1971 | United Kingdom . |
| 2020922 | 11/1979 | United Kingdom . |
| WO88/09068 | 11/1988 | WIPO . |
| WO90/16092 | 12/1990 | WIPO . |

*Primary Examiner*—Morris H. Nimmo

*Attorney, Agent, or Firm*—Gary L. Griswold; Walter N. Kirn; John C. Barnes

[57] ABSTRACT

A wire connector having a conductive barrel with a solder disc disposed in the barrel with wire retaining means to hold the wires in place during heating and melting of the solder disc to form a permanent connection. A shrinkable sleeve, provided with means of sealing, formed around the barrel and extending beyond the ends of the barrel is also shrunk down onto the wires to seal and insulate the connection and hold the wires.

10 Claims, 4 Drawing Sheets

WIRE CONNECTOR

This application is a continuation-in-part of application Ser. No. 08/017,852, filed Apr. 20, 1993, which is a continuation-in-part of application Ser. No. 07/835,803, filed Feb. 14, 1992, now abandoned.

FIELD OF THE INVENTION

This invention relates to wire connectors and in one aspect to a wire connector for making low profile butt splices between multiple conductors wherein the conductors are connected end to end.

BACKGROUND OF THE INVENTION

The prior art is replete with connecting devices for joining two or more wires in electrical contact to splice the same into a given circuit. The devices that are considered relevant to the background of this invention are not the insulation displacement connectors or the wire nut twist-on connectors but connectors where the wires are placed in end-to-end relationship for making a butt splice and maintained in electrical connection by a crimp connector, a weld or similar connection. Often the electrical connections will be insulated using heat-shrinkable tubular components. There are many examples of electrical connection devices which include heat-shrinkable components. Often the heat-shrinkable portion will be in the form of a tube or sleeve. The inner wall of the tube may be coated with an adhesive or sealant. When, positioned within the shrinkable tube, the means for joining conductors is found usually close to the central portion of the heat-shrink sleeve. The joining means is frequently a ring or band of solder as described, for example, in GB 1,149,125; U.S. Pat. No. 4,940,179 and WO 9,007,207. (Other related patents are: U.S. Pat. No. 4,722,471; U.S. Pat. No. 4,300,284; GB 2,020,922; U.S. Pat. No. 4,832,248; WO 8,809,068; U.S. Pat. No. 4,505,421 and U.S. Pat. No. 4,883,924). The use of bands or rings of solder are referred to as solder inserts or preforms. Such inserts perform the conventional function of soldering electrical conductors to provide an electrical connection. In some cases, the solder may be susceptible to and melted by high frequency alternating currents as described in U.S. Pat. No. 4,987,283 and U.S. Pat. No. 4,852,252. While the solder inserts have a well defined shape, in some cases they may be replaced by an undefined quantity of solder as disclosed in U.S. Pat. No. 4,654,473 and U.S. Pat. No. 4,384,404.

As an alternative, the solder components may be replaced by crimp barrels within the heat-shrink sleeves. Connectors which rely upon crimp barrels are described, for example, in U.S. Pat. No. Re 33591 and U.S. Pat. No. 4,993,149.

Another means of making electrical connection between conductors is revealed in U.S. Pat. No. 5,006,286. In this case the solder is replaced by a conductive gel medium. The gel, located centrally within a heat shrink sleeve, provides a conductive path between conductors which are inserted into and surrounded by, the conductive gel. When heat is applied, the heat-shrink sleeve recovers, gripping the insulation of the conducting wires. This prevents the conductors from withdrawing from the conductive gel. All of the foregoing examples suffer from a common problem. This problem is associated with the positioning of the wire conductors, insulated or otherwise, before they are joined by soldering, crimping or penetration of a conductive gel. This problem is especially acute in the latter case since the wires must be held in the desired relationship until the shrinkage and gripping action of the heat-shrink sleeve is complete. Therefore, to successfully connect conductors, using prior art devices, it is necessary to provide auxiliary clamping means to hold conductors in position, within the connector, prior to soldering, crimping, etc.

One piece of prior art, GB 2,020,922, teaches the use of an additional insert within a heat-shrink sleeve. This insert is used to hold and position wires which are inserted into the heat-shrink sleeve. However, this connecting device is useful only for connecting wires which are inserted from the same end of the connector. Also, it seems that the insert does not effect a gripping action while holding the wires in position nor does it appear useful in providing a reliable electrical connection. Thus, wires inserted and positioned in the connector are not reliably secured and electrically connected until soldering or twisting and heat-shrink procedures have been performed.

The present invention significantly simplifies the process of joining conductors electrically with a solder junction by eliminating the need for auxiliary clamping. It also provides an improvement over crimp connectors which are subject to damage by crimping tools which may cut through the heat-shrinkable insulating layer during the crimping process.

SUMMARY OF THE INVENTION

The connector of the present invention is adapted for making an electrical connection between a plurality of wires and insulating the connection. The connector comprises a conductive tubular member or sleeve, a disc of solder, placed in a centrally located slot generally perpendicular to the axis of the sleeve and a shrinkable sleeve. The conductive sleeve of an electrically conductive metal is formed with wire retaining means formed from the sleeve for gripping the wires upon insertion into the sleeve. The wire retaining means extend from the inner surface of the cylinder in the form of tabs. The tabs are located to extend into the sleeve from one side toward the other and toward the central portion of the sleeve from opposite ends. The solder disc is positioned within the sleeve between the tabs to initially form a wire stop, later to be melted to electrically join the ends of the wires abutting the disc. A shrinkable sleeve is positioned about the conductive sleeve with the conductive sleeve positioned generally midway between the ends of the shrinkable sleeve.

In a preferred embodiment, the tabs are formed from the conductive sleeve and the tabs have a length sufficient to extend past the longitudinal axis of the conductive sleeve and are stamped from the material of the sleeve to engage a bare wire inserted into the sleeve from either end and resist the retraction of the wire.

The solder disc is of a size to fit through a transverse opening or slot formed in the peripheral side walls of the sleeve.

The shrinkable sleeve is preferably heat shrinkable and in a variety of embodiments, the center portion of the sleeve is shrunk down onto the conductive sleeve. A pre-shrunk center portion of the heat shrink sleeve may extend along and beyond the length of the conductive sleeve. It is important, in the pre-shrinking of the heat shrink sleeve, that the resulting internal diameter of this sleeve is at least approximately equal to the external diameter of the conductive sleeve. This allows for the insertion of the optimum number of wires which can be accommodated by the conductive sleeve.

An important feature of the aforementioned connector is the dual function it provides by gripping or clamping inserted conductors and holding them in electrical contact prior to the formation of a more permanent connection e.g. soldering. Wires may be inserted from either end of the connector. The connector of this invention includes means for connecting and environmentally sealing and insulating both stranded and solid wire conductors in a range of wire gauge sizes. Connections between one wire and another may be made. Alternatively it is possible to connect multiple wires up to a limit defined by the available space within the connector. An adhesive may be placed within the shrinkable sleeve to further seal the sleeve to the wires. The adhesive may, for instance, be included as a continuous layer coated on the inner wall of the heat shrink sleeve or it may be appropriately positioned within the heat shrink sleeve in the form of pre-formed rings or sleeves of solid hot-melt adhesive compositions.

DESCRIPTION OF THE DRAWING

The present invention will be further described with reference to the accompanying drawing wherein.

DETAILED DESCRIPTION OF THE PRESENTLY PREFERRED EMBODIMENTS

Figure 1:
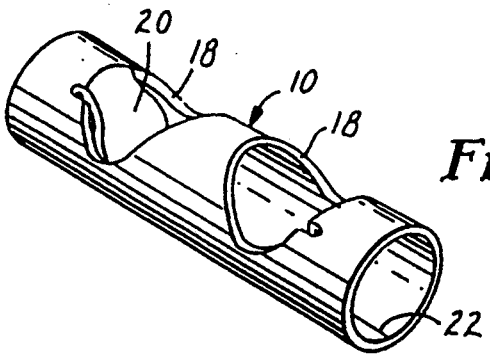
FIGS. 1 and 1*a* each show a perspective view of a tubular member forming part of the connector of the present invention.
Figure 1A:
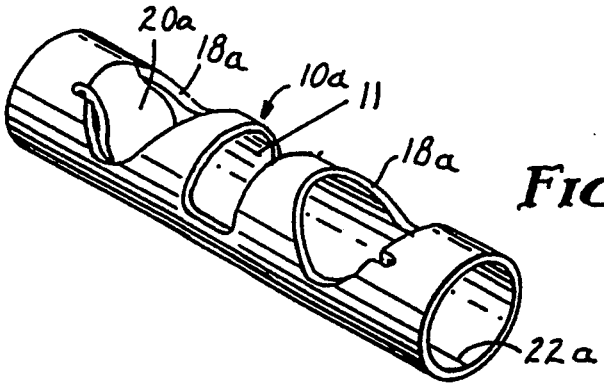
Figure 3:
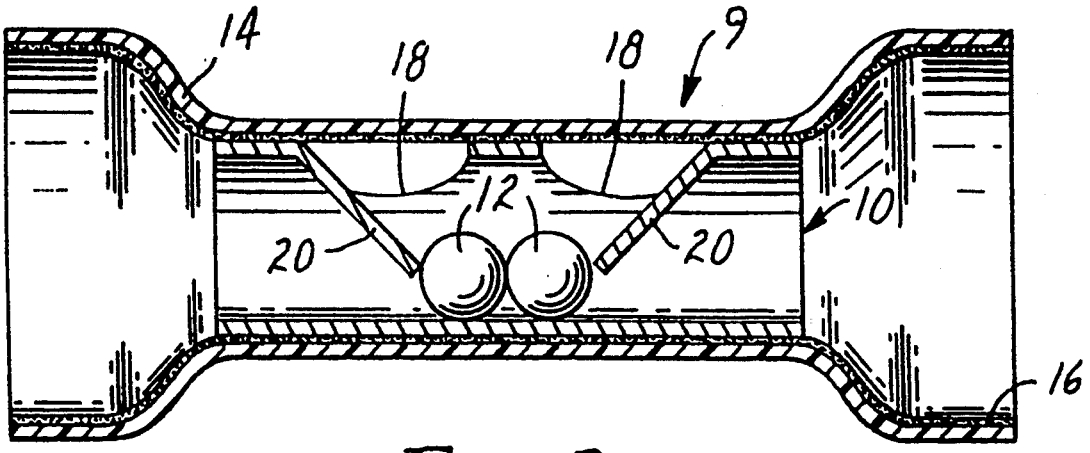
FIG. 3 is a longitudinal sectional view of a connector according to FIG. 1.
Figure 7:
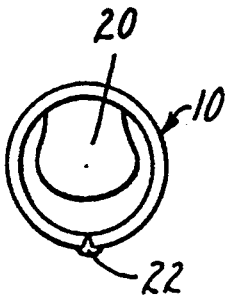
FIG. 7 is an end view of the tubular member illustrating the seam formed between the sides of the plate forming the tubular member to hold it in the tubular shape and illustrating the tabs depending from the inner surface of the tubular member.
Figure 8:
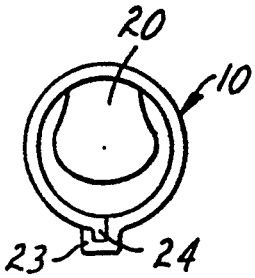
FIG. 8 is an end view similar to FIG. 7 illustrating a different form of seam between the side edges of the plate forming the tubular member to hold it in the tubular shape.
Figure 9:
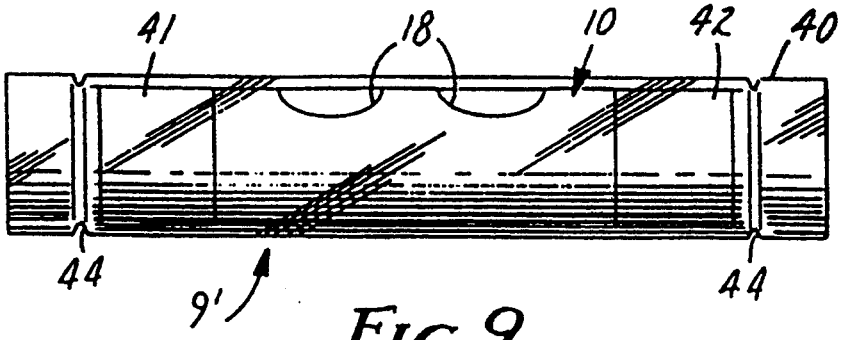
FIG. 9 is a side elevation view of a further embodiment of the connector according to the present invention.

The invention will be described with reference to the drawing wherein like reference numerals refer to like parts throughout the several views. In FIG. 1, a tubular member or cylindrical member 10 is illustrated which provides the connection device of the connector, which is generally indicated by the reference numeral 9. The connector 9, see FIG. 3, comprises the tubular conductive sleeve 10, having self actuated wire retaining means 20, formed from the conductive member, a mass of solder 12 and an outer shrinkable sleeve 14. The conductive sleeve 10 is formed from a rectangular sheet of conductive metal such as copper, brass, beryllium-copper, etc. which is tin plated. The sheet has opposite ends and sides and is cut or stamped to form the wire retaining means. As illustrated, the wire retaining means are formed by two U-shaped or horseshoe shaped cuts 18 made in the sheet. In FIG. 1*a*, the parts that are common to the parts of FIG. 1 include the same numbers with the suffix "a" and are similar. The sleeve 10*a* has an additional elongate transverse opening forming slot 11, in the periphery of the sleeve 10*a*, which may be cut initially in the rectangular sheet of metal. The sheet is then formed into a generally cylindrical shape to form the conductive sleeve 10. The area of the sheet within the cuts 18 are depressed into the sleeve 10, or bent along the un-cut edge, and this bending forms two window openings or interruptions in the sleeve 10 and two tabs 20 which extend down into the sleeve 10 toward the opposite inner wall surface of the tubular sleeve 10. As illustrated in FIGS. 7 and 8, the sheet is formed into a tubular member and the side edges of the sheet are joined by a bead of solder 22, see FIG. 7, or by an interlocking seam, including a C-shaped or rolled edge 23 on one side and a tongue 24 on the other side, see FIG. 8, to maintain the sheet in the tubular form. The conductive sleeve 10*a* may include slot 11 produced by the transverse wide cut formed to have a depth to allow a solder disc 13 to be placed transversely of the tubular member when the sheet is formed into tubular sleeve 10*a*.

The interruptions formed in the surface of the sleeve 10, form the retention tabs 20 and 20*a* but they also form windows which serve the function of allowing visual inspection of the inside of the sleeve. Through the interruptions in sleeve 10 are placed pieces of solder to define a mass of solder 12, illustrated in FIG. 2 and 2*a* as two spherically shaped masses or as three cylindrical rod shaped masses, which pieces are preferably coated with flux, to provide for the permanent connection of the wire ends to each other, to the wall of the metal sleeve, to the tabs 20, or all three. Use of conductive sleeve 10*a* provides a slot 11 and the solder disc 13, which, inserted through slot 11, may be used instead of rod or spherically shaped pieces of solder. Disc 13 contains or is coated with flux. The connection is achieved by heating the solder to a temperature in the range at which the solder melts.

The wire retention tabs 20 and 20*a* serve to provide wire retention in the sleeve. The die cutting or stamping of the horseshoe shaped cuts leaves the edges of the tabs rough and sharp, and the angle of the tabs extending into the sleeve afford the wire retention for two or more wires to be positioned and held in the sleeve 10 or 10*a*, under friction, or the mechanical gripping of the tab into the wire or wire sheath, before the heat is applied to complete the soldered connection. The free end of each retention tab 20 or 20*a* extends past the axis of the sleeve 10 or 10*a* and is located close to the inner surface of the sleeve opposite the side to which the tabs remain connected, see FIGS. 7 and 8. Any object, e.g. a wire, passing underneath the tab 20 or 20*a* from a direction from an end toward the nearest tab, will engage the tab and displace it resiliently, causing the wire to be gripped by the tab and held under friction. In the embodiment of FIGS. 1*a*, 2*b*, 4*a* and 11 a wire stop is formed in the sleeve 10*a* near the center, between the ends of the tabs. The wire stop is provided by the solder disc 13, located in slot 11, according to FIG. 2*b*. The tab 20*a* also positions the wire against the wall of the sleeve for subsequent engagement with the melted solder.

Figure 4:
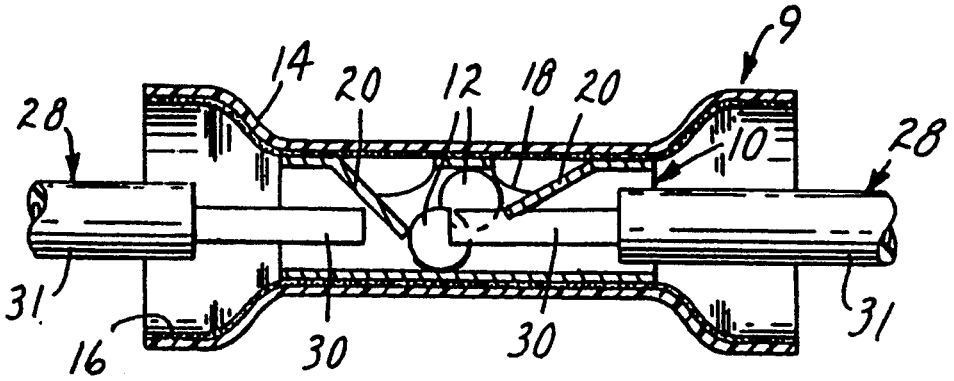
FIG. 4 is a longitudinal sectional view of a connector according to the present invention illustrating the insertion of wires into the connector of FIG. 1.
Figure 4A:
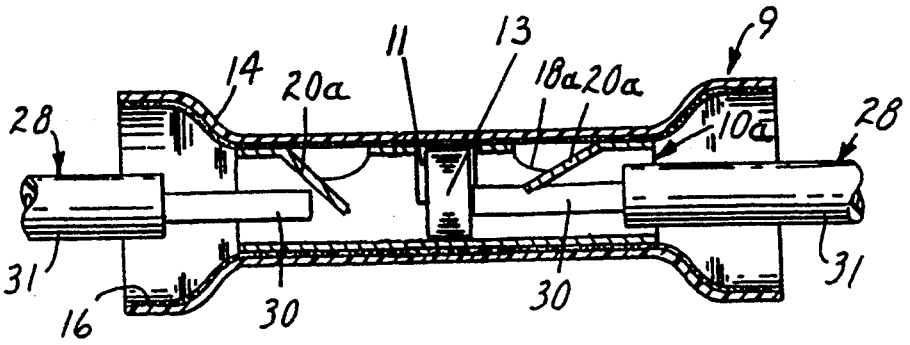
FIG. 4*a* is a longitudinal sectional view of a connection according to FIG. 1*a;*

While the sleeve 10 or 10*a* performs the desired function of connecting wires, it is necessary to provide an outer sleeve 14 of shrinkable material, preferably heat shrink material, if insulating the connection is desired. The insulative sleeve 14 is a dual wall heat shrink tube. The sleeve 14 is preferably made of a translucent or transparent heat shrinkable material. A transparent sleeve is desired so that a completed, soldered connection may be viewed after the connector 9 has been heated sufficiently to shrink the outer sleeve and melt the solder mass. Reference is now made to the dual wall nature of the heat shrink sleeve 14. This sleeve 14 is composed of two layers of material. The inner layer 16 of the sleeve 14 is a clear hot melt adhesive. This material becomes tacky with the application of heat. The outer sleeve 14 is formed preferably of a transparent polymer, identified by the tradename "Kynar" available from Pennwalt Corporation, Philadelphia, Pa. which is capable of withstanding temperatures above 250° C. for days when radiation crosslinked. The sleeve 10 or 10*a* and the solder mass 12 or solder disc 13, are positioned within the sleeve 14. The sleeve 14 fits against the exterior of the sleeve 10 or 10*a* to restrict the solder mass 12 or solder disc 13, described earlier, from becoming displaced from between the tabs 20 or 20*a*, and the sleeve 10 or 10*a* is centrally located within the shrinkable sleeve 14. Enough heat is applied to shrink the central portion of the "Kynar" tube so that it grips a portion of the metal cylinder and holds it securely. This relationship exists by the sleeve 10 or 10*a* and the shrinkable sleeve 14 having the proper sizes, internal diameter and outside diameter, or by using a heat shrinkable sleeve 14 and heating the central portion of the sleeve, and by localizing the heat, shrinking the central portion of the sleeve down onto the sleeve 10 or 10*a* to secure it in place prior to the use of the connector 9. This shrinking procedure leaves the ends of the sleeve 14 bell-mouthed, as illustrated in FIGS. 3, 4, 4*a* and 6, to accept the wire sheath introduced into the connector 9, as shown in FIGS. 4, 4*a* and 6.

Figure 5:
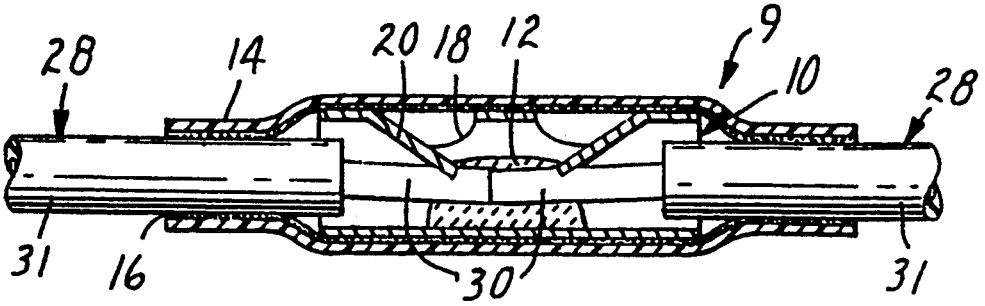
FIG. 5 .is a longitudinal sectional view of a completed electrical splice using a connector according to the present invention.

Connection of wires to the connector 9 is achieved, according to FIGS. 4, 4*a*, 5 and 6 by stripping the insulation from wires 28 at the ends to expose the conductor 30 beyond the end of the sheath 31. The wire end, or wire ends, are then inserted into each end of the conductive sleeve 10 or 10*a* a distance sufficient for the end to pass the free end of the respective tab 20 or 20*a* such that an initial connection, between the exposed conductor and the tab is formed. The wire thereafter cannot be easily withdrawn against the bracing force of the tabs 20 or 20*a* and the inner surface of the sleeve 10 or 10*a* opposite the tabs. Displacing the tabs 20 or 20*a* to allow entry of the conductors 30 may move the mass of solder 12 but it is maintained centered between the tabs and at the ends of the wires or conductor 30. Alternatively, when solder disc 13 is used in place of solder mass 12, a wire stop is provided which prevents insertion of the bare wire ends past the center portion of conductive sleeve 10*a*. In this way the wire ends are optimally positioned for connecting. When a permanent connection is desired, heat is applied to the outer surface of the sleeve 14. As the temperature increases to the melt temperature of the solder, e.g. about 160° C., the solder disc 13 or solder mass 12, coated with the flux, melts and contacts the exposed conductors positioned in the middle of the conductive sleeve 10 or 10*a*. This forms a permanent connection within the conductive sleeve, as shown by FIG. 5 wherein the solder disc 13 or solder mass 12 has changed to a reformed mass joining the wire ends, the tabs 20 and the conductive sleeve. At the same time the application of heat causes the heat shrinkable sleeve 14 to recover and close around the insulative sleeve 31 of the wires as also shown in FIG. 5. The heating also softens the hot-melt adhesive coating 16, if present, causing it to flow around the insulative sheath 31 and to seal to the wires 28. After application of the connector 9 to the wires, entry of moisture to the junction between the wires is restricted by the adhesive seal and it is still possible to view the completed, soldered connection through the outer protective sleeve 14.

If the adhesive coating is not present on the sleeve, but the sleeve 14 is heat shrinkable, the sleeve 14 will recover, under the influence of sufficient heat, and it will grip the outer insulative sleeve of the inserted wires 28 and insulate the wire junction, but the seal may not restrict moisture penetration into the sleeve.

Figure 6:
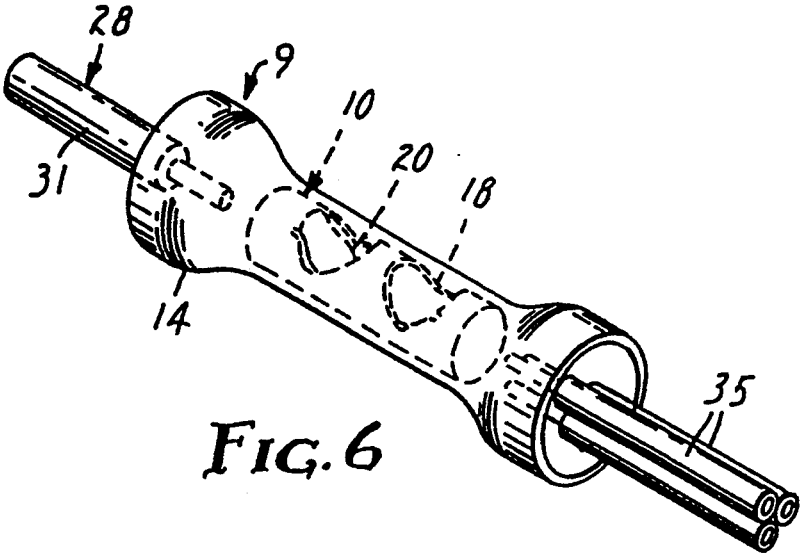
FIG. 6 is a perspective view of a connector of the present invention and of wires having conductors exposed at the ends.

FIG. 6 illustrates the transparent nature of the shrinkable sleeve 14. This figure also illustrates the use of the connector 9 with a plurality of wires 35 being inserted at one end of the conductive sleeve 10 and a single wire at the opposite end as is quite normal in the construction of wire harnesses.

It is possible to use the connector of the present invention with the addition of thermoplastic inserts placed inside the ends of the heat shrink sleeve 14. When wires 28 are placed inside the connector and through the thermoplastic inserts, the heat to shrink the sleeve 14 will cause the adhesive inserts and solder to melt. As the heat shrink tube recovers around the wires the thermoplastic insert material will flow around the sheath of the wires. This provides the desired seal to prevent ingress of moisture or other contaminants.

The formation of the conductive sleeve 10 or 10*a* is partially described above but includes the steps of cutting into a sheet of electrically conductive material, having two opposite sides and two ends, to include a centrally located, elongate opening and/or a pair of generally U-shaped cuts with the open ends of the U positioned oppositely of each other and opening toward the ends of the sheet. The sheet is then formed into a hollow tubular member and held in that form by joining the opposite sides of the sheet to form a seam to maintain the sheet in the tubular position. It is preferred to degrease the metal tubular portion, prior to assembling the connector, to ensure that oily contaminants, essential to metal stamping, do not interfere with electrical connection development. When included, the elongate opening, between the U-shaped cuts, forms a slot having a longitudinal axis which extends for less than half of the periphery of the hollow tubular member. The center cut portions of the sheet are depressed into the tubular member past the center axis of the tubular member. A solder disc is inserted with frictional engagement into the slot or a mass of solder is placed through the windows formed upon bending or depressing the cut out portions of the sheet into the tubular member. The placing of the solder into the tubular member positions the solder between the inturned tabs. The tubular member is then inserted into a shrinkable sleeve to be positioned between the ends of the shrinkable sleeve. The shrinkable sleeve can be heated locally to shrink down onto a portion of the outer surface of the sleeve 10 or 10*a* to restrict the displacement of the cylinder from the open ends of the shrinkable sleeve and to retain the solder in the tubular sleeve 10 or 10*a*. The assembled connector is clearly shown in FIG. 3 or 4*a*.

Examples of connectors of this invention are given as follows:

EXAMPLE 1

One connector of the present invention is comprised of a heat shrink tube 14, a cylindrical metal connector 10, and two solder inserts 12 in the form of small spheres. The heat shrink tube is a two layer construction comprising an outer transparent heat shrink sleeve which is coated internally with a transparent layer of hot melt adhesive 16.

Assembly of the connector of the present invention is achieved via a series of steps.

Step 1. The tin plated metal sheet is cut or stamped, and formed into a cylindrical form. The cylinder is degreased and positioned, horizontally on a fixture, with the interruptions or observation holes or "windows" disposed on its upper surface or facing upwards.

Step 2. Two flux-core or flux-coated solder balls of low temperature solder of 43 percent lead, 43 percent tin and 14 percent bismuth, with a melt temperature of 163° C., are placed in the cylinder by inserting one through each of the observation holes.

Step 3. The heat shrink sleeve component is slipped over the connecting cylinder until it reaches a stop associated with the assembly fixture. At this point the conductive cylinder is centrally located with respect to the longitudinal axis of the heat shrink sleeve.

Step 4. During this stage, the connector enters a heat tunnel where it is selectively heated only in the center section covering the conductive sleeve. This attaches the heat shrink sleeve 14 to the outer surface of the cylinder 10 but leaves opposite ends of the sleeve expanded to receive wires for connection.

EXAMPLE 2

Figure 2:
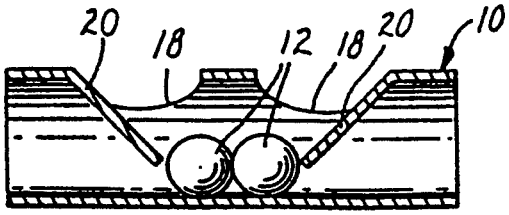
FIGS. 2, 2*a* and 2*b* show a longitudinal sectional view of the tubular member of FIG. 1 or 1*a*, showing the placement of a mass of solder to provide an electrical connection of solder in the tubular member.
Figure 2A:
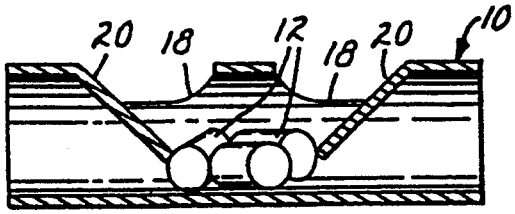

A second embodiment of a connector of the present invention is illustrated in FIG. 2*a*, wherein the cylindrical sleeve 10 is washed to remove the oily film, and the solder mass is inserted into the sleeve. The solder mass 12 comprises cylindrical shaped pieces of solder, cut from a rod and coated with a flux.

EXAMPLE 3

A further embodiment of a connector 9' comprises a heat shrink tube 40, a cylindrical metal connector 10, and solder inserts in a form according to FIG. 2 or 2*a*. The heat shrink tube 40 is a transparent heat shrink sleeve. Hollow tubular sections 41 and 42 of a thermoplastic hot melt adhesive/sealant are positioned at each end of the cylindrical metal sleeve 10. The outside diameter of each hot melt adhesive sleeve is approximately equal to the inside diameter of the cylindrical metal sleeve and an end of the sleeves 41 and 42 are positioned in the respective ends of the sleeve 10. Assembly of this connector 9' is achieved via a series of steps.

Step 1. The tin plated metal sheet is cut or stamped, and prepared as in Example 1.

Step 2. Flux-core or flux-coated pieces of solder, cylindrical rods, of low temperature solder of 43 percent lead, 43 percent tin and 14 percent bismuth, with a melt temperature of 163° C., are placed in the cylinder 10 by inserting the same through the observation holes.

Step 3. The heat shrink sleeve component 40 is slipped over the connecting cylinder 10 until it reaches a stop associated with the assembly fixture. At this point the conductive cylinder is centrally located with respect to the longitudinal axis of the heat shrink sleeve.

Step 4. During this stage, the connector enters a heat tunnel where it is selectively heated only in the section 45 covering a central portion of the conductive sleeve, see FIG. 10. This attaches the heat shrink sleeve to the outer surface of the connecting cylinder.

Step 5. Tubular sections or sleeves 41 and 42 of hot-melt sealant are positioned one at each end of the connecting cylindrical sleeve 10. The heat shrink sleeve 40 is transparent, heat shrinkable and has an inside diameter substantially the same as the outside diameter of the sleeve 10 or it can be shrunk down onto the sleeve 10 as explained above and does not have an interior coating. The sleeve 40 can be further selectively heated at two points 44, along its length, to shrink over a portion of each of the hot-melt sealant sleeves 41 and 42 sufficiently for the interior diameter of the sleeve 40 in the areas 44 to be less than the outside diameter of the sleeves 41 and 42 for retaining the hot-melt sleeves and the conductive sleeve within the shrinkable sleeve 40 during shipping and handling.

Figure 10:
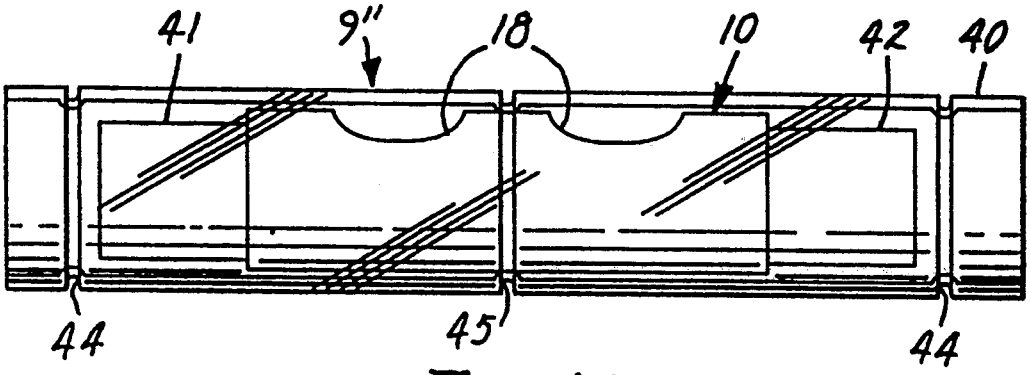
FIG. 10 is a side elevation view of a further embodiment of the connector.

An alternative is a connector 9'' illustrated in FIG. 10 wherein tubular sleeves 41 and 42 of hot-melt sealant are positioned one on each end of the connecting cylindrical sleeve 10, with the end of the sleeves 41 and 42 positioned in the end of the sleeve 10. The heat shrink sleeve 40 is shrunk down by localized heating to form a groove 45 in the central area of the sleeve 40 to grip the center of the conductive sleeve 10, and is also selectively heated in the two areas 44 over a portion of each of the hot-melt sealant sleeves 41 and 42 sufficiently for retaining the hot-melt sleeves within the shrinkable sleeve 40 during shipping and handling.

Figure 11:
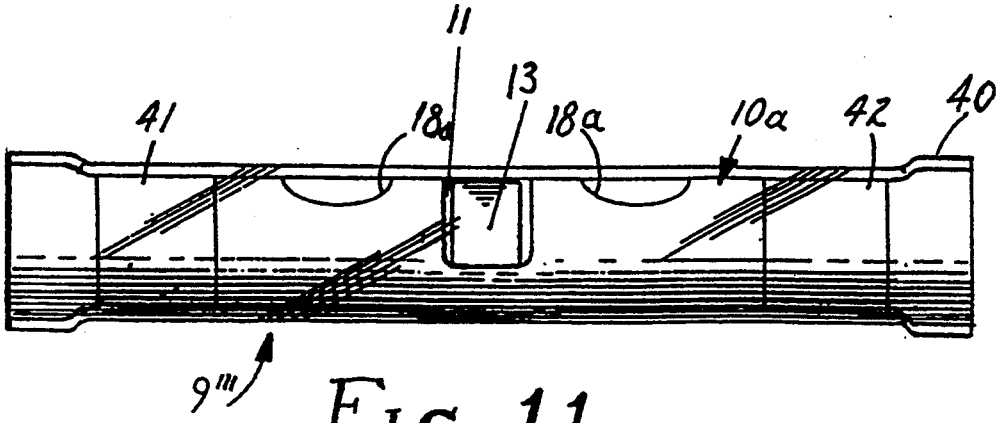
FIG. 11 is a side elevation view of a further embodiment of the connector of the present invention illustrating the use of the tubular member of FIG. 1*a* and a shrinkable sleeve with adhesive tubular members.

Further, as illustrated in FIG. 11, the tubular sleeves 41 and 42 of hot-melt sealant are positioned one on each end of the connecting cylinder. The heat shrink sleeve is heated along its length to shrink the sleeve to a diameter sufficient for retaining the hot-melt sleeves, 41 and 42, together with the conductive sleeve 10*a* within the shrinkable sleeve 40 during shipping and handling. The ends of sleeve 40 are not shrunk.

The thermoplastic sleeves 41 and 42 comprise ethylene vinyl acetate, polyvinylidene fluoride and other additives such as fillers, pigments, antioxidants, etc. The thermoplastic sleeves are preferably opaque such that upon the connector 9', 9'' or 9''' being placed over wires entering the sleeve 10 or 10*a* from opposite ends, the connector is subjected to heat sufficient to shrink the sleeve 40, melt the solder disc 13 or solder mass 12 and the hot melt sleeves 41 and 42. It can thus be seen that the solder will flow about the wire ends in the sleeve 10 or 10*a* and that the hot melt sleeves will have become molten and flow about the wires and the inner surface of the sleeve 40 to seal the ends of the insulative sleeve 40 about the wire ends. As well as melting to form a water impervious seal at each end of the spliced connection, the sealant material changes in color, e.g. from blue to green. This thermal color indication occurs within a temperature range at which a very effective soldered connection is formed at the wire junction. Thus the hot-melt sealant performs a dual function of environmental sealant and indicator of a successfully sealed and soldered joint.

EXAMPLE 4

Figure 2B:
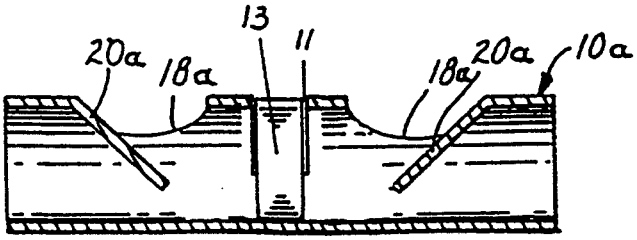

The cylindrical metal connector and solder inserts of Examples 1 through 3 may be replaced, in wire connectors of this invention, by cylindrical metal connector 10*a* containing a solder disc 13. This cylindrical metal connector includes a slot 11 as shown in FIG. 2*b* into which the flux-core or flux-coated solder disc 13 is inserted. The solder disc obviates the use of pieces of solder while performing a beneficial function as a wire stop which prevents inserted bare wire ends from entering the cylindrical metal connector beyond the approximate midpoint thereof. In performing the function of a wire stop, the solder disc 11 is sized so that upon insertion into the slot 11, frictional contact occurs between the ends of the slot 11 and the side faces of the solder disc 13. Positioned in the cylindrical metal connector, the disc 13 will substantially fill the slot 11 and also close off the barrel portion of the cylindrical metal connector forming a transverse barrier. When in its preferred position, the solder disc 13 is generally perpendicular to the axis of the metal cylinder with its upper peripheral portion extending into but not beyond the gap formed in the wall of the cylindrical metal connector 10*a* by the slot 11. Thus positioned, movement of the solder disc 13 is restricted by the frictional engagement of the ends of the slot 11 and side walls with the disc 13. It is possible to use the heat shrink tubing and sealing means used either in Example 1 or Example 3 with the cylindrical metal connector 10*a* described here.

A distinguishing feature of the connector is the incorporation of a wire insert and retention or clamping component adjacent to each opening of the connector itself. This clamping component is metallic in nature and performs a dual function. Firstly, it is designed to grip the bare wires which are inserted into the connector. This eliminates the need for auxiliary holding equipment such as special jigs or fixtures. In addition, the metal to metal contact assures the formation of electrical continuity. A more reliable electrical connection is then made by uniting the conductors by soldering. By joining the conductors at two points within the connecting component an extremely reliable electrical junction is obtained. An additional feature of the invention is a wire stop made of a solder disc which assists in the positioning and joining of wires inserted in a connector of the invention. The wire stop places the wires in optimum relationship to be reliably connected during heating. A further distinguishing feature of the invention is provided by the use of hot-melt sealant, color indicating sleeves on either side of the metal tubular connector. These sleeves provide visual confirmation that temperatures have been reached at which a reliable, soldered electrical connection has been formed and sealed from undesirable contaminants.

Electrical connectors according to the present invention are useful for joining current carrying wires in a variety of applications. There is interest especially in making connections in e.g. wiring harnesses which are useful in automotive applications and domestic appliances.

Having described the present invention, with specific reference to the preferred embodiment and variations, it is to be understood that other modifications can be made by those skilled in the art without departing from the spirit of scope of the invention as defined by the appended claims.

We claim:

1. A wire connector for making an electrical connection between a plurality of wires and forming an insulated connection comprises:

a hollow tubular conductive member of electrically conductive metal having self actuated wire retaining means formed from the material of the tubular conductive member, positioned adjacent the ends of the tubular conductive member and extending into the tubular member for affording wire retention for wires inserted into the tubular conductive member, means defining a slot in the periphery of said tubular conductive member and extending about the periphery at a location between said retaining means, a disc formed of solder material disposed in said slot and said tubular conductive member against which said inserted wires can abut, and a shrinkable sleeve positioned about said tubular conductive member with the tubular conductive member positioned generally midway between the ends thereof and with the inner diameter of the shrinkable sleeve fitted to the outside surface of the tubular member to enclose the tubular member and provide an insulative cover.

2. A connector as defined in claim 1 wherein the shrinkable sleeve is heat shrinkable and the sleeve has a coating of adhesive disposed on the inner surface of the shrinkable sleeve.

3. A connector as defined in claim 1 wherein said shrinkable sleeve is heat shrinkable and a pair of hollow tubular sleeves of a thermoplastic are inserted into the sleeve, one tubular sleeve at each end of the conductive member for sealing the ends of the shrinkable sleeve to the wires upon shrinking said sleeve.

4. A connector according to claim 3 wherein the tubular sleeves are opaque.

5. A connector according to claim 1 wherein said shrinkable sleeve is heat shrinkable and transparent.

6. A connector according to claim 1 wherein said disc of solder is of a size to fit through said slot in the periphery of said tubular conductive member.

7. A connector according to claim 6 wherein the shrinkable sleeve is heat shrinkable.

8. A connector as defined in claim 7 wherein the shrinkable sleeve is heat shrinkable and the sleeve has a thermoplastic adhesive disposed within the shrinkable sleeve at each end of the conductive sleeve.

9. A connector according to claim 4 wherein said shrinkable sleeve is transparent.

10. A connector according to claim 1 wherein said shrinkable sleeve is transparent.

* * * * *